US006789862B2

(12) United States Patent
Shih-Long et al.

(10) Patent No.: US 6,789,862 B2
(45) Date of Patent: Sep. 14, 2004

(54) RUNNER FOR A DRAWER

(75) Inventors: Hwang Shih-Long, Kaohsiung Hsien (TW); Chen Ken-Ching, Kaohsiung Hsien (TW); Chih-Lin Ou, Kaohsiung Hsien (TW)

(73) Assignee: King Slide Works Co., Ltd., Taiwan (CN)

( * ) Notice: Subject to any disclaimer, the term of this patent is extended or adjusted under 35 U.S.C. 154(b) by 102 days.

(21) Appl. No.: 10/189,479

(22) Filed: Jul. 8, 2002

(65) Prior Publication Data

US 2003/0209958 A1 Nov. 13, 2003

(30) Foreign Application Priority Data

May 10, 2002 (TW) ..... 91206825 U

(51) Int. Cl.[7] ..... A47B 88/04
(52) U.S. Cl. ..... 312/334.46; 384/18
(58) Field of Search ..... 312/334.44, 334.45, 312/334.46, 333, 330.1, 331; 384/18, 21

(56) References Cited

U.S. PATENT DOCUMENTS 4,537,450 A * 8/1985 Baxter ..... 384/18
4,696,582 A * 9/1987 Kasten ..... 384/18
4,932,792 A * 6/1990 Baxter ..... 384/18
6,145,944 A * 11/2000 Bayani et al. ..... 312/334.44
6,244,678 B1 * 6/2001 Dopp et al. ..... 312/333
6,254,209 B1 * 7/2001 Parvin ..... 312/334.44
6,280,086 B1 * 8/2001 Stijns ..... 384/18
6,435,636 B1 * 8/2002 MacMillan ..... 312/334.46

FOREIGN PATENT DOCUMENTS

EP 0476745 A1 * 3/1992
JP 07039430 A * 2/1995 ..... 312/334.44

* cited by examiner

*Primary Examiner*—Lanna Mai
*Assistant Examiner*—Hanh V. Tran
(74) *Attorney, Agent, or Firm*—Bacon & Thomas, PLLC

(57) ABSTRACT

A runner for slidably supporting a drawer includes a telescopic rail assembly having a first rail and a second rail. The rails are movable one along another to allow the telescopic rail assembly to be varied between an elongated position and a shortened position. The runner further includes a retainer having a first piece fastened to the first rail and a second piece fastened to the second rail. The first piece of the retainer is adapted to releasably snap onto the second piece when the telescopic rail assembly is in the elongated position.

4 Claims, 6 Drawing Sheets

RUNNER FOR A DRAWER

BACKGROUND OF THE INVENTION

1. Field of the Invention

The present invention relates to a runner for a drawer and, more particularly, to a runner which prevents a drawer from retreated abruptly in accidence.

2. Description of Related Art

It is known that there is a telescopic runner used for slidably supporting a drawer. As shown in FIG. 8, the runner includes an outer rail 91, an intermediate rail 92 and an inner rail 93, with a plurality of balls 94 intervening between the two rails 92, 93 to provide a smooth movement of the inner rail 93 relative to the intermediate one 92. Furthermore, the inner rail 93 is provided with a paw 95 that has a rigid toe 951 and a resiliently flexible toe 96, and the intermediate rail 92 is provided with a stop 97 that is formed with a protrusion 971.

In fact, the resiliently flexible toe 96 serves as a torsion spring which keeps the rigid toe 951 in such a place that the toe 951 may be correctly engaged with the protrusion 971 of the stop 97 before the inner rail 93 is fully extended out of the intermediate rail 92. This engagement prevents the rails 92, 93 from separating in their longitudinal direction.

However, it has been found that the resiliently flexible toe 96 usually breaks up soon, so that the drawer slidably supported on the runner may be drawn out excessively and finally falls. Moreover, the drawn-out drawer may probably retreat abruptly in accidence, bring the user into a risk of being hurt at the hand(s), especially the fingers.

OBJECT OF THE INVENTION

The object of the present invention is to provide a durable runner for slidably supporting a drawer.

Another object of the present invention is to provide a runner which prevents the drawer from retreating abruptly in accidence.

SUMMARY OF THE INVENTION

An improved runner provided for slidably supporting a drawer includes a telescopic rail assembly having a first rail and a second rail, and a retainer having a first piece fastened to the first rail and a second piece fastened to the second rail. The rails are movable one along another to allow the telescopic rail assembly to be varied between an elongated position and a shortened position. Particularly, the first piece of the retainer is adapted to releasably snap onto the second piece when the telescopic rail assembly is in the elongated position.

Other objects, advantages and novel features of the invention will become more apparent from the following detailed description when taken in conjunction with the accompanying drawings.

DETAILED DESCRIPTION OF THE PREFERRED EMBODIMENT

Figure 1:
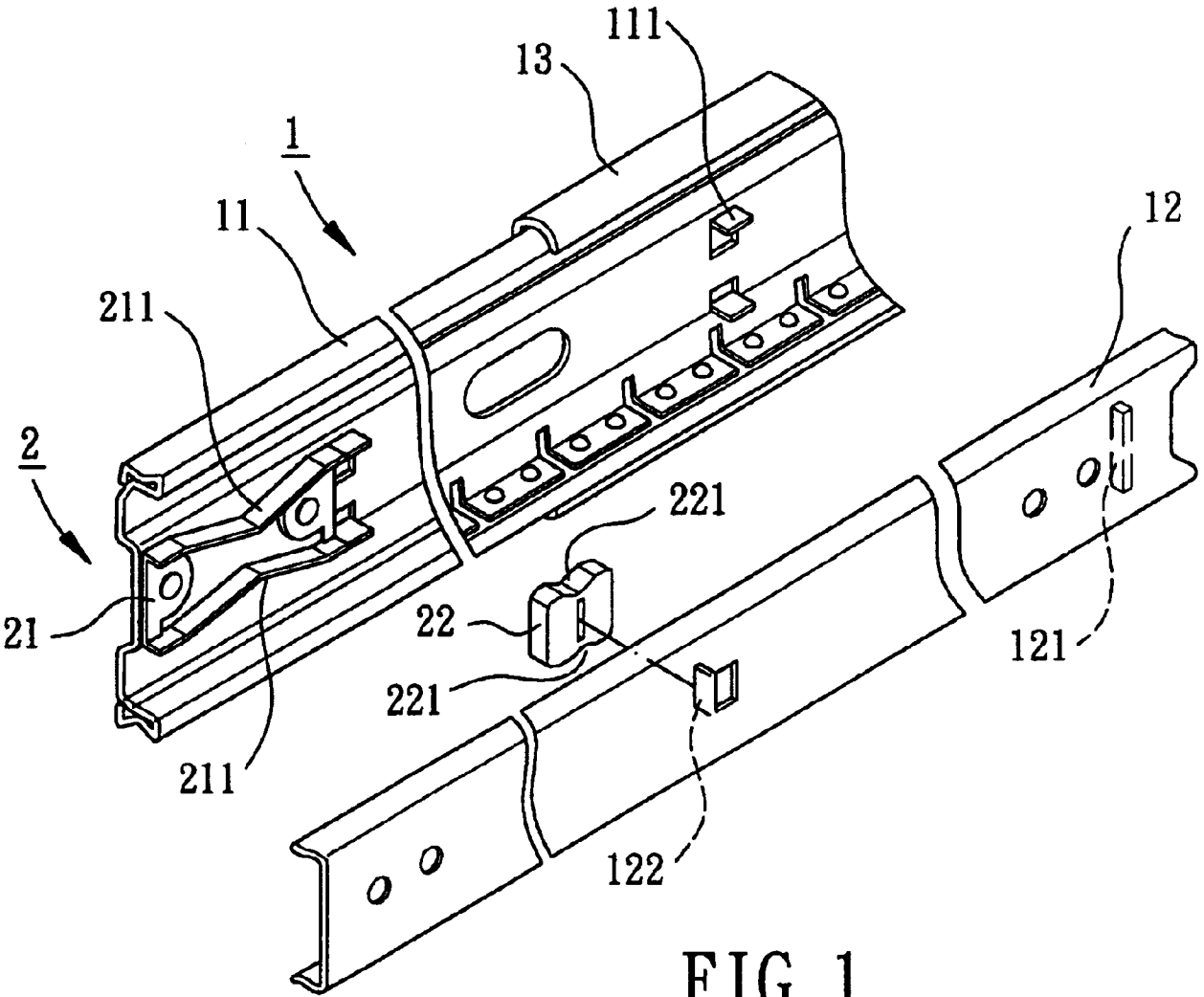
FIG. 1 is an exploded perspective view of a first embodiment of a runner in accordance with the present invention for slidably supporting a drawer.

Referring to FIG. 1, there is shown a first embodiment of a runner in accordance with the present invention for slidably supporting a drawer. The inventive runner includes a telescopic rail assembly 1 and a retainer 2.

The telescopic rail assembly 1 includes a first rail 11, a second rail 12 and optionally a third rail 13, with the rails 11, 12, 13 being movable one along another to allow the telescopic rail assembly 1 to be varied between an elongated position and a shortened position.

Figure 3:
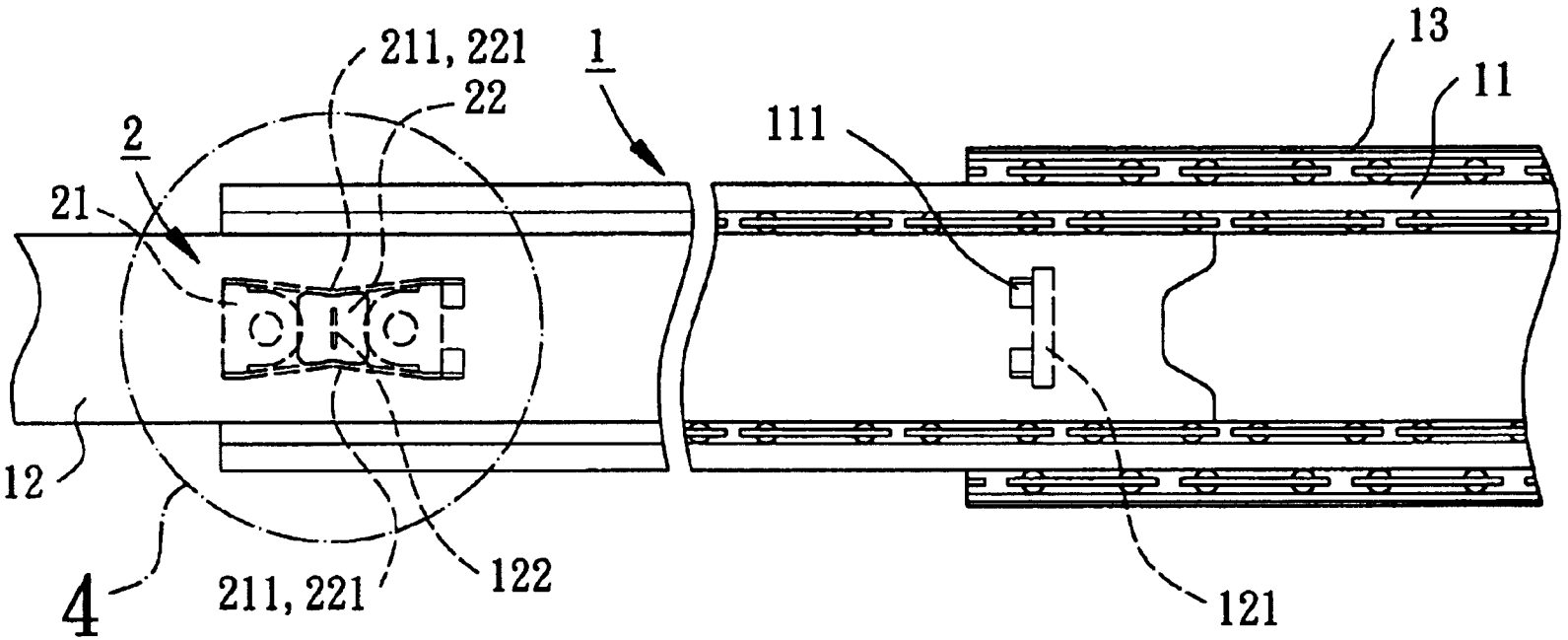
FIG. 3 is a front view of the runner of FIG. 1, showing the telescopic rail assembly in its elongated position.

The elongated position of the rail assembly 1 can be achieved in many way. For example, the rails 11, 12 may be formed with respective stops 111, 121 which are engaged with each other before the first rail 11 is fully moved out of the second rail 12, as best shown in FIG. 3. It is clear that the engagement between the stops 111, 121 prevents the rails 11, 12 from separating in their longitudinal direction.

The retainer 2 includes a first piece 21 fastened to the first rail 11 and a second piece 22 fastened to the second rail 12. In the illustrated embodiment, the first piece 21 is riveted to the first rail 11 while the second piece 22 is held on a tab 122 integrally extending from the second rail 12. As can be clearly seen, the first piece 21 further has a pair of resilient, inwardly-curved wings 211 formed on the top and bottom thereof, and the second piece 22 has a pair of recesses 221, each preferably shaped as a V slot, defined in the top or the bottom of the second piece 22.

Figure 2:
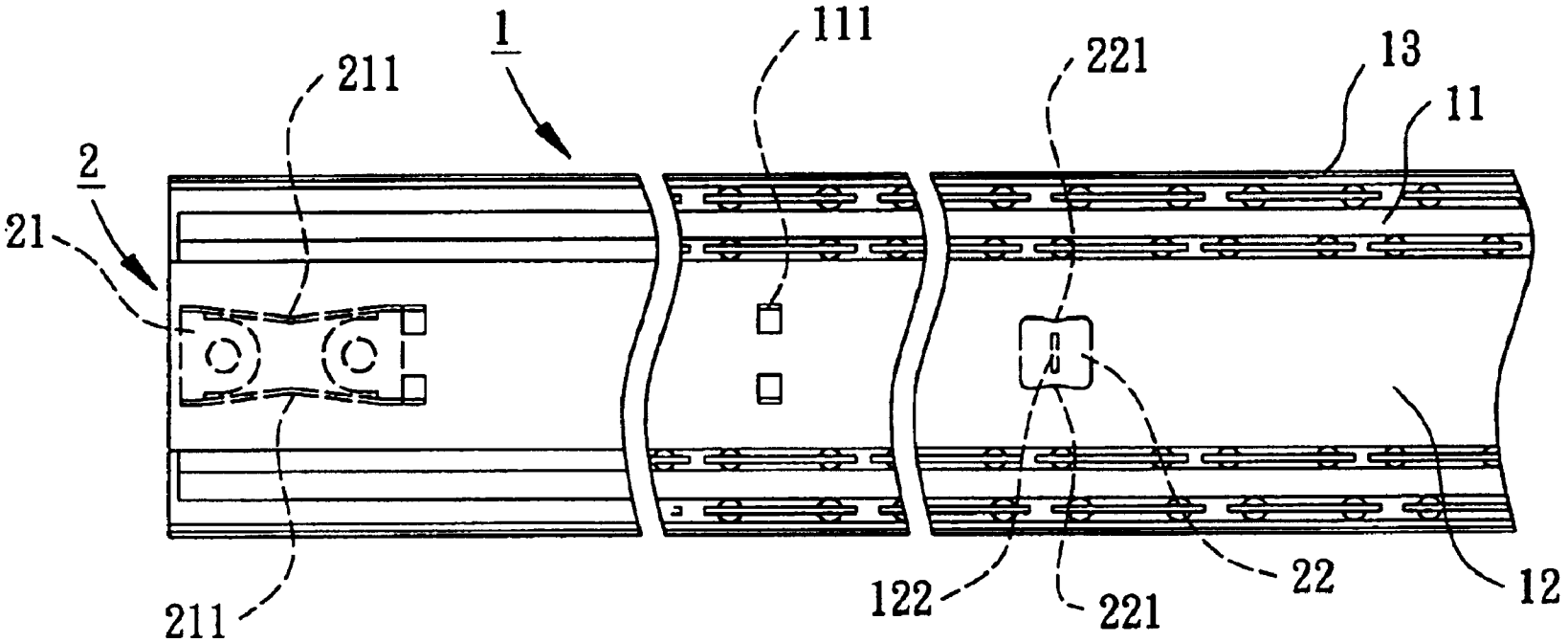
FIG. 2 is a front view of the runner of FIG. 1, showing a telescopic rail assembly in its shortened position.

Referring to FIG. 2, the two pieces 21, 22 of the retainer 2 are away from each other when the telescopic rail assembly 1 is in its shortened position.

Figure 4:
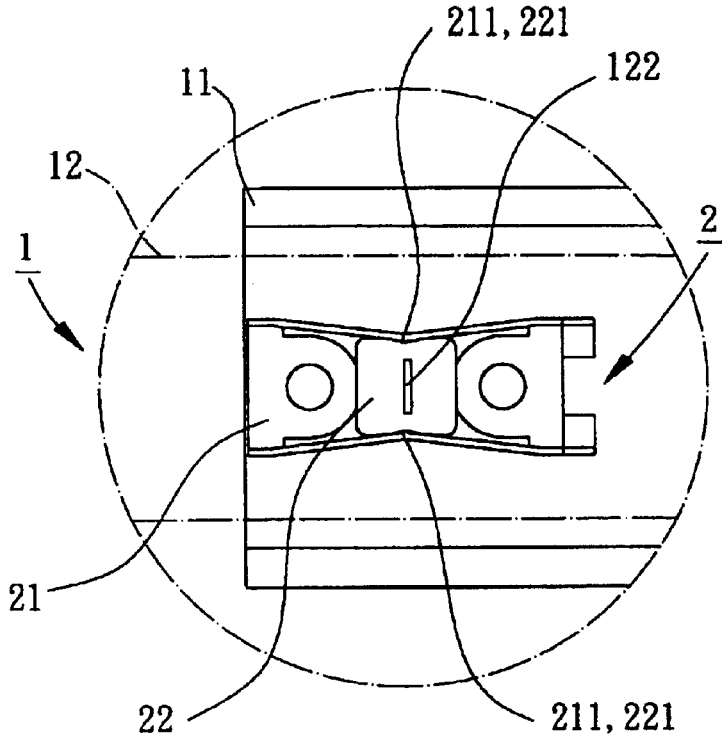
FIG. 4 is an enlarged front view taken from part 4 in FIG. 3.

Referring to FIG. 3, when the telescopic rail assembly 1 is fully extended, the resilient, inwardly-curved wings 211 of the first piece 21 will releasably snap onto the second piece 22 in the V-shaped recesses 221, as best shown in FIG. 4, thereby retaining the rail assembly 1 in its elongated position.

Figure 5:
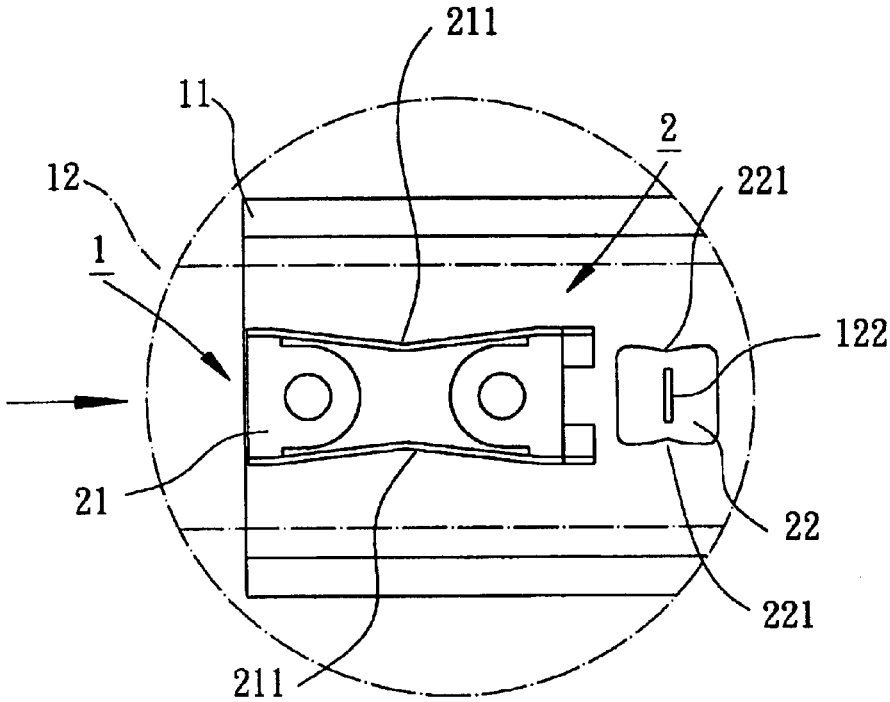
FIG. 5 is an enlarged front view showing two pieces of a retainer being away from each other.

In consequence, it is conceivable that the drawer will not retreat abruptly in accidence. The drawer will remain open until a relative large force is exerted on it, when the second piece 22 of the retainer 2 is released from the first piece 21, as best shown in FIG. 5, and the rail assembly 1 is compressed to its shortened position.

Figure 6:
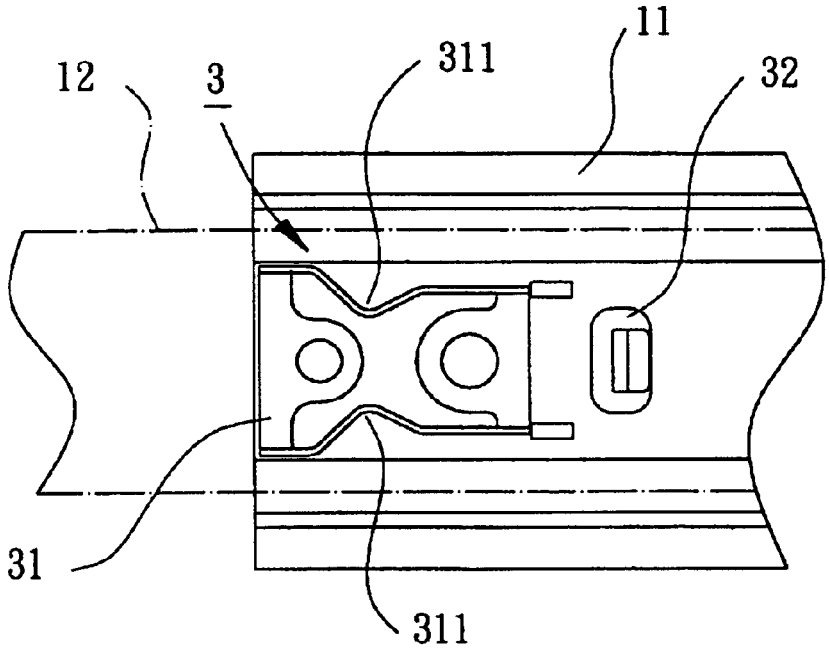
FIG. 6 is an enlarged front view of a second embodiment of the runner in accordance with the present invention.

Referring to FIG. 6, there is shown a second embodiment of the runner in accordance with the present invention.

In this embodiment, the inventive runner includes an alternative retainer 3 that has a first piece 31 formed with a pair of resilient, inwardly-curved wings 311, and a second piece 32 formed with a flat top and a flat bottom.

Figure 7:
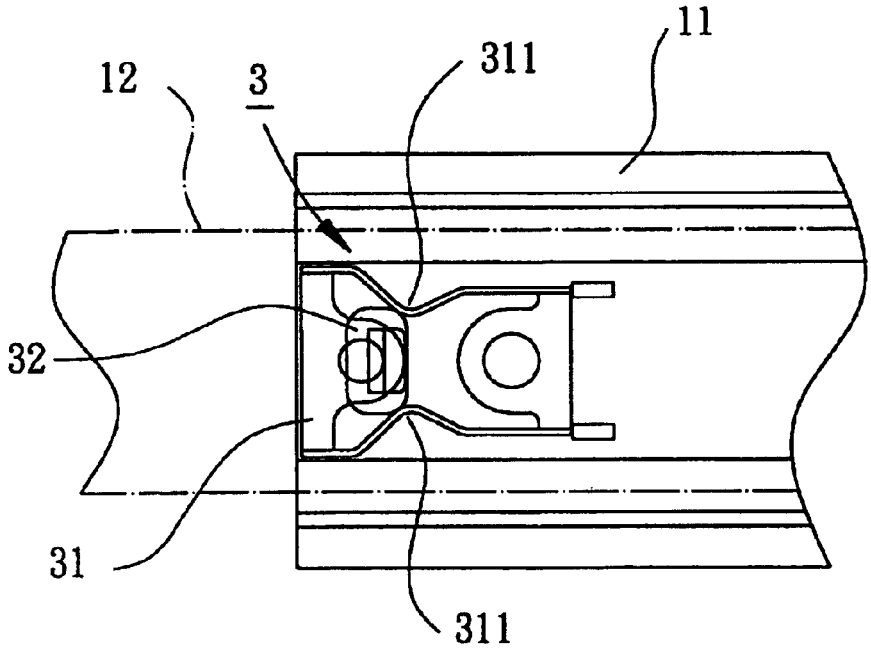
FIG. 7 is a front view of the runner of FIG. 6, showing the telescopic rail assembly in its elongated position.
Figure 8:
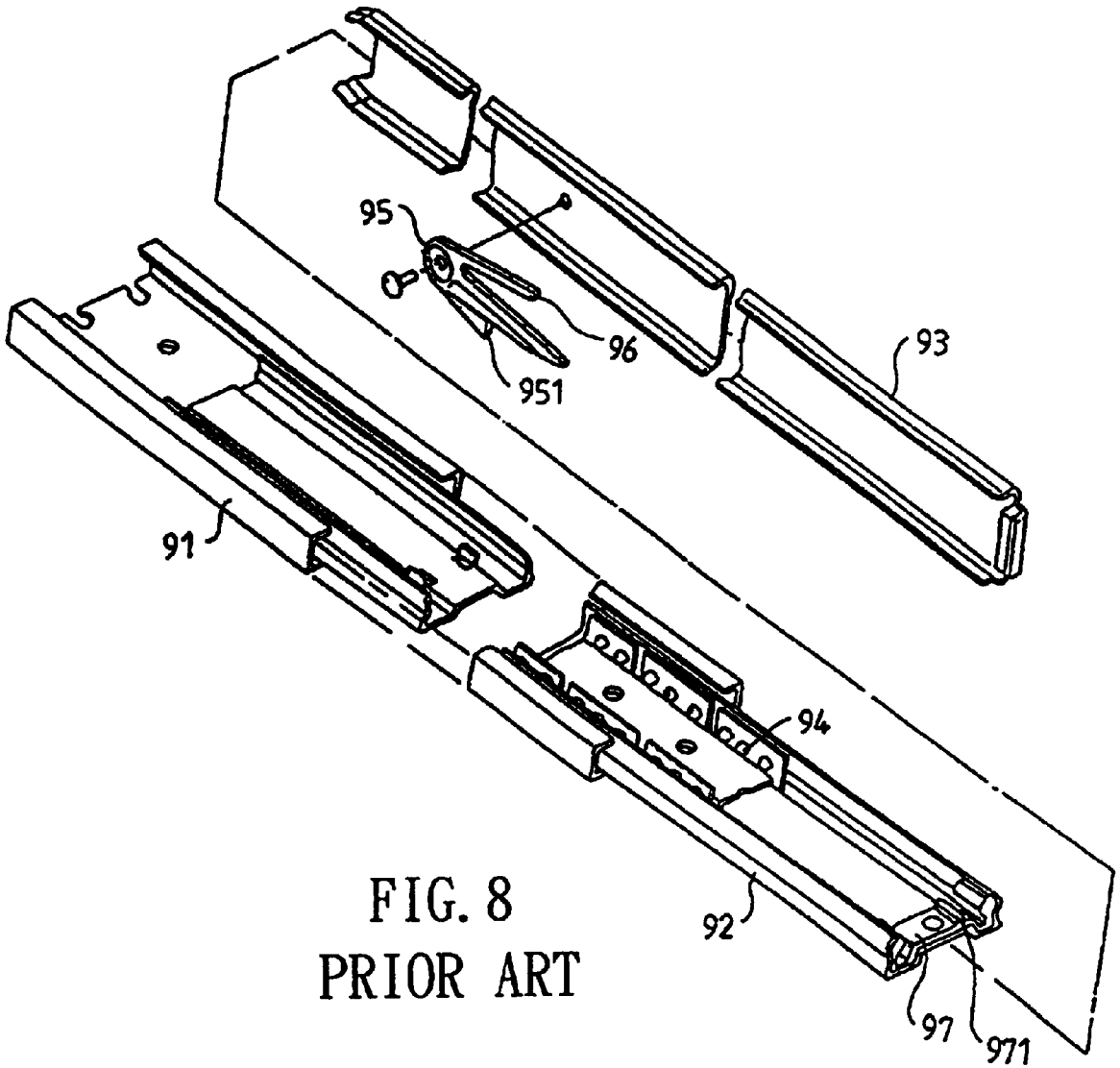
FIG. 8 PRIOR ART
FIG. 8 is an exploded perspective view of a conventional runner used for slidably supporting a drawer.

Referring to FIG. 7, the two pieces 31, 32 here are fastened to the rails 11, 12 in such locations that most part of the second piece 32 may be moved beyond the tips of the inwardly-curved wings 311 of the first piece 31.

At the time when the rail assembly 1 is fully extended, the resilient, inwardly-curved wings 311 will snap on the second piece 22 at rounded rear ends of the flat top and bottom. This retains the rail assembly 1 in its elongated position and prevents the drawn-out drawer from retreating abruptly in accidence.

From the foregoing, it is apparent that this invention has the advantage of preventing the drawer from retreating abruptly in accidence.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A runner for a drawer, comprising:

a telescopic rail assembly having a first rail and a second rail;

said rails being movable one along another to allow said telescopic rail assembly to be varied between an elongated position and a shortened position;

a retainer having a first piece fastened to said first rail and a second piece fastened to said second rail;

wherein said first piece comprises a first connecting end portion and a second connecting end portion that securely connect said first piece with said first rail;

said first piece further including an elastically engaging portion longitudinally extended and mounted between said first and second connecting end portions so that said first and second connecting end portions structurally reinforce said elastically engaging portion to ensure passage of said second piece therethrough for engaging operation; and wherein said elastically engaging portion of the first piece is adapted to releasably snap onto said second piece when said telescopic rain assembly is either in said elongated or shortened position.

2. The runner as claimed in claim 1, wherein said first piece of said retainer has a pair of resilient upwardly-curved wings mounted on said first and second connecting end portions for reinforcing the entire structure of said first piece, said resilient, inwardly-curved wings are adapted to releasably snap onto said second piece when said telescopic rail assembly is either in said elongated or shortened position.

3. The runner as claimed in claim 2, wherein said second piece has a pair of recesses defined therein, and wherein said resilient, inwardly-curved wings of said first piece are adapted to releasably snap onto said second piece in said recesses.

4. The runner as claimed in claim 3, wherein each of said recesses of said second piece is shaped as a V slot.

* * * * *